US005907135A

United States Patent [19]

Hayakawa et al.

[11] Patent Number: 5,907,135

[45] Date of Patent: May 25, 1999

[54] EXHAUST MUFFLER

[75] Inventors: Masaaki Hayakawa; Hiroshi Mitsuyoshi; Yasuo Masuda, all of Kumamoto, Japan

[73] Assignee: Honda Giken Kogyo Kabushiki Kaisha, Tokyo, Japan

[21] Appl. No.: 08/878,829

[22] Filed: Jun. 20, 1997

[30] Foreign Application Priority Data

Jul. 11, 1996 [JP] Japan ..... 8-181840
Sep. 10, 1996 [JP] Japan ..... 8-238289

[51] Int. Cl.[6] ..... F01N 7/18

[52] U.S. Cl. ..... 181/282; 181/272

[58] Field of Search ..... 181/243, 252, 181/256, 264, 267, 269, 272, 282, 227, 228

[56] References Cited

U.S. PATENT DOCUMENTS

| | | | |
|---|---|---|---|
| 4,132,286 | 1/1979 | Hasui et al. | 181/269 |
| 4,278,147 | 7/1981 | Watanabe et al. | 181/272 |
| 4,290,501 | 9/1981 | Tanaka | 181/228 |
| 4,332,307 | 6/1982 | Ito | 181/272 |
| 4,415,059 | 11/1983 | Hayashi | 181/272 |
| 5,597,986 | 1/1997 | Harwood et al. | 181/282 |

*Primary Examiner*—Khanh Dang
*Attorney, Agent, or Firm*—Merchant, Gould, Smith, Edell, Welter & Schmidt

[57] ABSTRACT

An exhaust muffler comprising an outer cylindrical body, front and rear end plates mounted on each end of the outer cylindrical body, porous plates fitted on the insides of the outer cylindrical body and each of the end plates, and partition plates for dividing the internal space of the outer cylindrical body into several chambers, wherein when joining the component parts with each other, three or four component parts are superposed via their joint portions each on the other and integrally joined by laser beam welding so as to obtain a reduction of welding steps and minimize the thermal influence in the manufacturing process while ensuring an air-tight condition of the partitioned chambers. When an exhaust pipe and tail pipe are connected to the end plates, respectively, they are laser beam welded to the end plates in a superposed fashion. Alternatively, the outer cylindrical body is formed in a multiple-layered construction with inner and outer panels which are so formed integral with each other as to squeeze or press inwardly, when assembling, an internally installed unit over its fill periphery, thereby not requiring particular measures for fixedly securing the internally installed unit to the outer cylindrical body. Preferably the outer cylindrical body and end plates are formed on an aluminum-plated or a stainless steel plate, thereby dispensing with a coating after welding.

17 Claims, 10 Drawing Sheets

EXHAUST MUFFLER

BACKGROUND OF THE INVENTION

1. Field of the Invention

The present invention relates to an exhaust muffler, and more particularly to a manufacturing technology of an exhaust muffler for use in motor vehicles such as motorcycles, motorcars or the like.

2. Description of the Prior Art

Generally, as an exhaust muffler for use in motor vehicles, there is known a type of exhaust muffler which has a joint construction as seen in FIG. 11, for example. The exhaust muffler 51 is provided with an outer cylindrical body 52 of rolled steel plate, a pair of end plates 53, 54 of rolled steel plate each joined with a front, and a rear ends of the outer cylindrical body 52, and an internally installed unit 55 accommodated within the outer cylindrical body 52. The internally installed unit 55 comprises porous plates 5G, 57, 58 arranged on and spaced apart from the inside surfaces of the outer cylindrical body 52 and each of the end plates 53, 54, partition plates 59, 60, 61 for partitioning the longitudinally extending internal space of the outer cylindrical body 52 into several chambers, and a plurality of communication pipes carried on each of the partition plates 59, 60, 61 and extending into and between each of the partitioned chambers. An acoustic absorption material 62 of glass wool or the like is inserted into clearances formed between the outer cylindrical body 52 and the porous plate 56 and between each of the end plates 53, 54 and each of the porous plates 57,58. When assembling this type of muffler 51, the outer cylindrical body 52, on a predetermined region of which a plurality of plug holes are provided preparatory to welding, is rolled into a cylindrical shape while the internally installed unit 55 is formed into an assembly by winding the porous plate 56 around the partition plates 59, 60, 61 which carry the communication pipes thereon. The internally installed unit 55 is inserted into the outer cylindrical body 52 in such a way that the plug holes for the welding of the outer cylindrical body 52 are positioned on the joint portions of each of the partition plates 59, 60, 61. Then, the outer cylindrical body 52 and the internally installed unit 55 are partially fixed to each other, prior to being completely joined, by spot welding, for example, and next completely joined with each other through the plug holes of the outer cylindrical body 52 by MIG (metal inert gas) welding.

The pair of front and rear end plates 53, 54 are firstly engaged with each of the corresponding porous plates 57, 58 to form the respective assembled units. The assembled units are joined by welding with the front and rear ends of the outer cylindrical body 52 so that the exhaust muffler is completely assembled.

In this manufacturing process, however, many steps for welding and others are required, and the surface treated regions of the outer cylindrical body 52 and the end plates 53, 54 each made of rolled steel plate are thermally affected at the time of welding and suffer surface destruction to a large extent which requires an after-treatment such is a full surface coating. Also, it, is necessary to cope with the thermal strain due to welding. Further, since the welding between the partition plates 59, 60, 61 and the outer cylindrical body 52 is done by the spot, welding through the plug holes of the latter, it is difficult to have the partitioned chambers kept in a sufficient air-tight condition.

On the other hand, there is known an exhaust muffler 51 with an outer cylindrical body of double or multiple rolled construction. The exhaust. muffler 51 of this type has better characteristics than the same with a single rolled outer cylindrical body 52 with respect to noise absorption, and thus may be made compact in size, while enabling the internally installed unit 55 to be simplified. This type of multiple-rolled outer cylindrical body is made by rolling up a sheet of steel plate material into a double- or multiple-layered cylindrical shape through roll forming or other processes. The internally installed unit 55 is thereafter inserted into and coupled with the thus-formed outer cylindrical body 52. The multiple-rolled outer cylindrical body of this type, however, is not capable of squeezing or tightly holding the internally installed unit 55 with the outer cylindrical body 52 when they are joined with each other. The joining method between the internally installed unit 55 and the outer cylindrical body therefore becomes complicated, whereby the manufacturing process takes a long time and an air-tight, condition of the partitioned chambers may not, be maintained.

Furthermore, when the outer cylindrical body 52 is formed in a multiple-layered construction from a single sheet of steel plate material, there remain some difficulties in obtaining a reduction in weight, a diversification of design in external appearance, a reduction in cost of material and the like.

SUMMARY OF THE INVENTION

It is therefore an object, of the present, invention to provide an exhaust muffler which is capable of simplifying the manufacturing process, avoiding the thermal influence and ensuring a better air-tight condition of the internal chambers.

Another object of the present invention is to provide an exhaust muffler in which, when adopting an outer cylindrical body of multiple-layered construction an internally installed unit is sufficiently squeezed by and installed in the outer cylindrical body so as to ensure a good air-tight condition without welding between the internally installed unit and the outer cylindrical body, while providing for weight reduction, a diversification of design in external appearance and a reduction in cost of material with respect to the exhaust muffler.

With a view to achieving the first object mentioned above, the present invention provides an exhaust muffler comprising an outer cylindrical body, an end plate coupled through its joint portion with at least a side of a front and a rear ends of the outer cylindrical body, and an internally installed unit adapted to be arranged within the outer cylindrical body, the internally installed unit comprising a porous plate arranged on and spaced apart from at least one of the inside surfaces of the outer cylindrical body and the end plate, and a partition plate adapted to partition an internal space defined by the outer cylindrical body in the forward and rearward direction thereof, characterized in that the porous plate is placed through its joint portion on at least one of the joint regions between the outer cylindrical body and the end plate and between the outer cylindrical body and the partition plate so as to be integrally joined together by laser beam welding. With this construction, at least three parts either the outer cylindrical body, the end plate and the porous plate, or the outer cylindrical body, the partition plate and the porous plate are placed each on the other at their respective joint portions so as to be joined with each other simultaneously by the laser beam welding which is applied to a full periphery of the outer cylindrical body along the circumferential direction of the latter. Therefore, no assembling prior to the welding of these parts into a unit is required, whereby several manufacturing steps may be dispensed with. The thermal influence may be minimized by the application of laser beam welding which contributes to reducing problems with thermal strain. Since the parts are joined with each other along the full circumference of the outer cylindrical body, a better air-tight condition may be obtained relative to the partitioned chambers within the outer cylindrical body. Further, due to the application of the laser beam welding, there is no need to form the plug holes on the outer cylindrical body which are necessary for MIG welding.

In another aspect of the present, invention, an exhaust muffler comprises an outer cylindrical body formed with a pair of halves, and a pair of porous plates fitted on and spaced apart from the inside surfaces of said pair of halves of the outer cylindrical body, wherein the porous plates are interposed through their joint portions between joint portions of the pair of halves of the outer cylindrical body so as to be integrally joined with each other by laser beam welding. In case the outer cylindrical body is constructed with the pair of halves, the joint portions of the pair of porous plates are interposed between the joint portions of the pair of halves of the outer cylindrical body and laser-beam-welded simultaneously to each other. In this manner, a reduction in manufacturing steps and the minimization of thermal influences upon welding may be effectively obtained.

When an exhaust pipe is connected to the front end plate, the porous plate is interposed through its joint portion between the exhaust, pipe and the end plate so as to be integrally joined by laser beam welding. Thus, these three parts are joined simultaneously by the laser beam welding, thereby enabling the reduction in manufacturing steps and the minimization of thermally affected regions to be achieved. Similarly, when a tail pipe is connected to the rear end plate, the joint portion of the porous plate is interposed between the tail pipe and the real end plate and they are integrally joined together by laser beam welding. In this case, the reduction in manufacturing steps and the minimization of thermal influences such as thermal strains may be also achieved by having these three parts joined with each other simultaneously by the laser beam welding.

Preferably, the outer cylindrical body and each of the front and the rear end plates are made of either an aluminum plated steel plate or a stainless steel plate, or varying combinations of both. With the application of the aluminum plated steel plate and the stainless steel plate, a process of full surface coating after welding, which is inevitable with respect to the rolled steel plate for use in the conventional exhaust muffler may be dispensed with. Besides, it is possible to meet the requirements of varying external designs. Namely, the aluminum-plated steel plate and the stainless steel plate may be easily welded in a variety of configurations by the laser beam, since the surgical oxidized films of these steel plates are easily removed due to the high density energy of the laser beam, and the corrosion-resistant coating is not especially required, since the welded region is protected by a passive anti-corrosive operation.

For the outer cylindrical body and the front and rear end plates, there may be employed either the aluminum plated steel plate or the stainless steel plate, or varying combinations of both, for example, in such a way as to employ the aluminum plated steel plate for each of the end plates and the stainless steel plate for the outer cylindrical body.

In order to achieve the second object mentioned above, the exhaust, muffler according to the present invention comprises an outer cylindrical body of multiple-layered construction provided with a plurality of an inner and outer panels substantially of a same configuration which are integrally formed simultaneously in a superposed fashion. With such a construction of the outer cylindrical body, when assembling the internally installed unit into the outer cylindrical body, the internally installed unit may be effectively squeezed by the outer cylindrical body, like in the case of the conventional single-layered outer cylindrical body, so that the internally installed unit, may be fixedly secured and joined to the outer cylindrical body so as to dispense with a welding step between the internally installed unit, and the outer cylindrical body.

Upon forming the multiple-layered outer cylindrical body, the inner and outer panels of the outer cylindrical body are superposed each on the other and turned once over into a cylindrical shape simultaneously by a roll forming process. The roll forming, which is an effective process in case the outer cylindrical body is not divided but formed into an integral cylindrical shape, enables the inner and the outer panels to be rolled in tight contact relationship with each other.

When the outer cylindrical body consists of a pair of halves, each of the pair of half bodies is integrally formed by stamping a plurality of superposed inner and outer panels into shape at the same time. In this case, a plurality of the inner and outer panels are placed each on the other and stamped into a multiple-layered semi-cylindrical body through a press forming process. Then, a pair of the multiple-layered semi-cylindrical bodies are laser-beam-welded at the joint portions thereof while pressing or squeezing the outer periphery of the internally installed unit between themselves. The stamping press forming in tight contact relationship between the inner and outer panels makes it possible to easily handle the multiple-layered semi-cylindrical bodies during the coupling step thereof.

The end plate of the exhaust muffler in accordance with the present invention is formed with a plurality of inner and outer panels which are superposed each on the other and integrally formed at the same time through a press forming process. With application of the multiple-layered construction of the inner and outer panels to the end plate, there may be obtained an improvement in noise silencing effect, an improvement in external appearance and an omission of a coating step after welding. The end plate, integrally formed in multiple-layered construction, is also convenient for handling during a step of welding to the outer cylindrical body.

Preferably, the inner and outer panels of the outer cylindrical body and the end plate are made of heterogeneous materials. The application of the heterogeneous materials to the inner and outer panels may comply with demands of diversified design in external appearance and with requirements for a reduction in cost of material. The inner and outer panels are formed different, in thickness from each other so as to comply with requirements for the reduction not, only in weight but in material cost.

Further, with respect to the outer cylindrical body and the end plate of multiple-layered construction, the outer panel is formed of heat-resistant and corrosion-resistant materials such as a stainless steel plate, an aluminum-plated steel plate or the like, while the inner panel is formed of rolled steel plate. This rolled steel plate, generally referred to as an SP material, is formed by rolling a low carbon steel through a hot rolling press or a cold rolling press. When the heat-resistant and corrosion-resistant materials such as the stainless steel plate, the aluminum-plated steel plate or the like are utilized for the outer panel, any after-treatment, like a corrosion-resistant coating after welding, for example, may be dispensed with. When the rolled steel plate is utilized for the inner panel, there may be obtained a reduction in material cost while ensuring the strength to be required. Upon forming the outer cylindrical body and the end plate of the inner and outer panels, an engaging means is provided for obtaining engagement, between the inner and outer panels, whereby preventing the inner and outer panels from separation and thus making it easy to handle them during assembling, thereby to contribute to an improvement in productivity.

BRIEF DESCRIPTION OF THE DRAWINGS

The above and other objects and the attendant advantages of the present invention will become more apparent by reference to the following detailed description when considered with the accompanying drawings wherein.

DETAILED DESCRIPTION OF THE PREFERRED EMBODIMENTS

Figure 1:
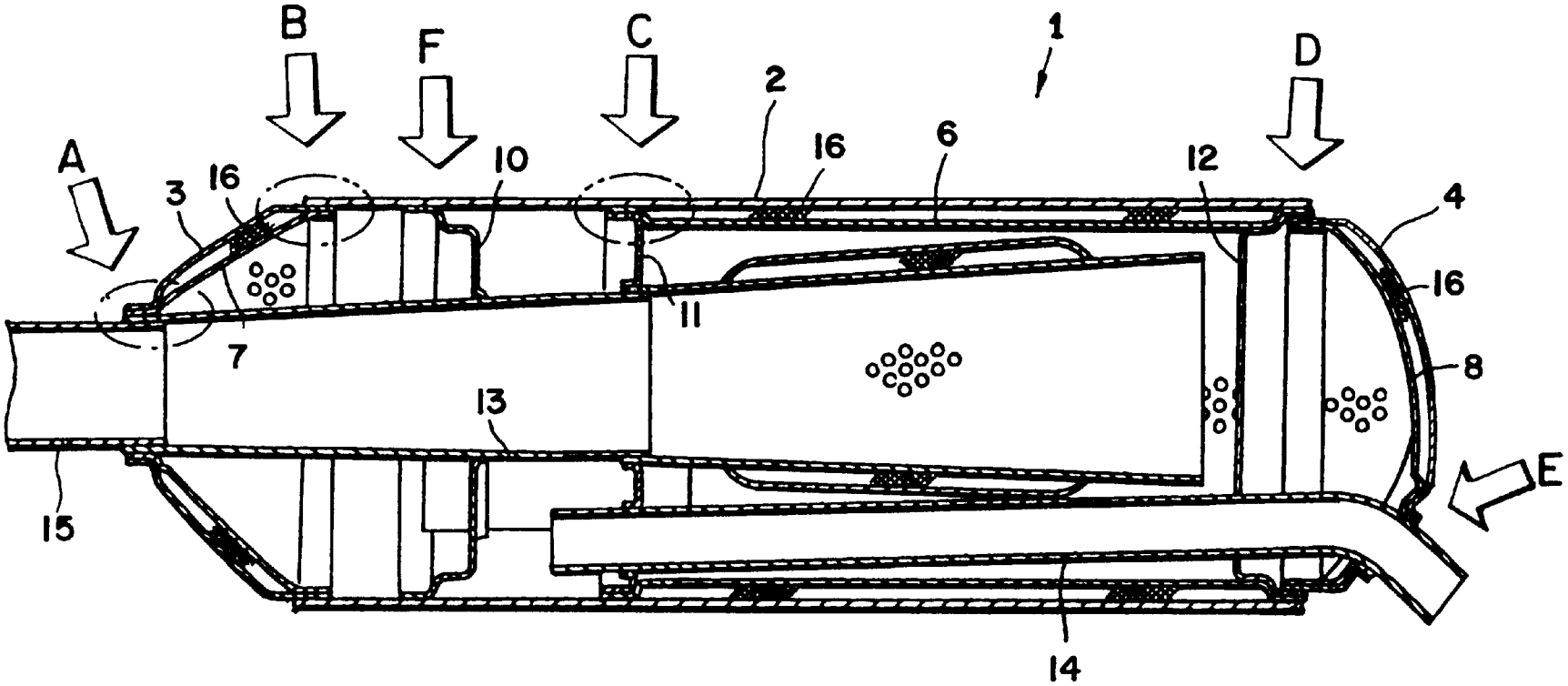
FIG. 1 is a longitudinal sectional view of an exhaust muffler according to the present invention.
Figure 2A:
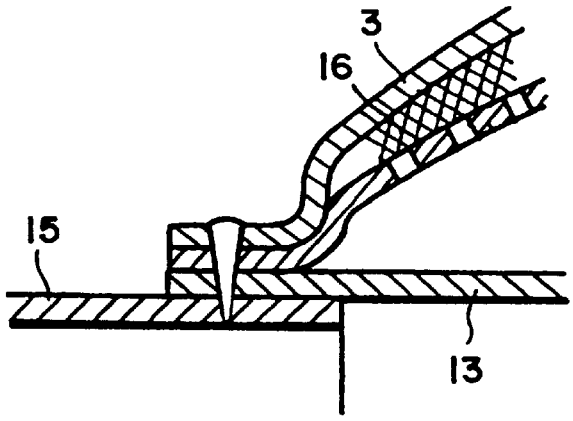
FIG. 2(A), (B) and (C) are fragmentary sectional views, in an enlarged scale, of joint regions of the exhaust muffler shown in FIG 1, (A) illustrating the joint region of an arrow (A), (B) being the joint region of an arrow (B) and (C) being the joint region of an arrow (C)
Figure 2B:
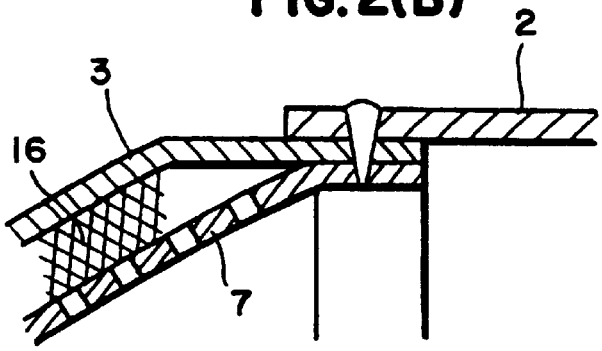
Figure 2C:
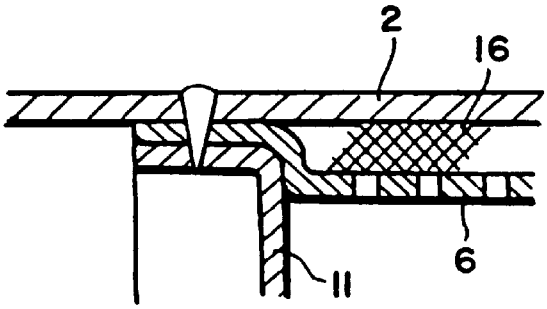

Referring now to the drawings, wherein like reference characters designate like or corresponding parts throughout the several views, FIG. 1 shows an exhaust muffler 1 of the present invention which is provided with an outer cylindrical body 2, a front and a rear end plate 3, 4 coupled respectively with the front and rear ends of the outer cylindrical body 2, and an internally installed unit 5 arranged within the outer cylindrical body 2. The internally installed unit 5 comprises a porous plate 6 arranged on and spaced apart from the inside of the outer cylindrical body 2, a front and a rear porous plate 7, 8 joined to and spaced with a predetermined clearance from each of the end plates 3, 4, a plurality of partition plates 10, 11, 12 for partitioning a longitudinally extending internal space of the outer cylindrical body 2 into several chambers in a forward and a rearward direction thereof, a plurality of communications pipes 13 arranged to keep in communication between the partitioned chambers within the outer cylindrical body 2, and a tail pipe 14 serving at the same time as a communication pipe. The central communication pipe 13 is carried at the forward end thereof on the front end plate 3, and the tail pipe 14 is carried at, the rearward end thereof on the rear end plate 4 with its rear end projecting outwardly. To the front end of the communication pipe 13 is connected an exhaust pipe 15 which is in communication with all engine (not shown). An acoustic absorption material 16 of glass wool or the like is accommodated within clearances formed between the outer cylindrical body 2 and the porous plate 6 and between each of the end plates 3, 4 and each of the porous plates 7, 8. In this type of exhaust muffler 1, in order to achieve the reduction in manufacturing steps, the minimization of the thermal influence due to welding and the improvement in an internal air-tight condition which correspond to the first object, of the present invention, each of joint regions relating to the outer cylindrical body 2, the end plates 3, 4, the porous plates 6, 7, 8 and the partition plates 10, 11, 12 is so constructed as seen in FIGS. 2(A)–(C). Namely, in a joint region A of FIG. 1, as seen in an enlarged scale in FIG. 2(A), there are superposed each on the other the front end plate 3, the porous plate 7, a joint end of the communication pipe 13 and a joint end of the exhaust pipe 15, so that a laser beam may be applied from an outside of the end plate 3 substantially at a right angle to the axial direction of the exhaust muffler 1. The superposed four component parts are welded together simultaneously and joined integrally with each other over their full peripheries by the penetrating laser beam which is applied along the circumferential direction thereof. By adoption of the laser beam welding, there may be minimized the destruction of the surface-treated layer of the end plate 3 around the welded region, since the laser beam is narrow in width, and additionally there may be avoided any thermal influences such as thermal strains since the thermal influence is restricted to the limited range. Moreover, high-speed welding may be carried out since the heat is focused rapidly on only a limited area.

Next, with reference to the joint region B of FIG. 1, as seen in FIG. 2(B), three component parts consisting of the outer cylindrical body 2, the front end plate 3 and the porous plate 7 are superposed at their joint end portions each on the other and welded together simultaneously from an outside of the outer cylindrical body 2 by the penetrating laser beam so as to be integrally joined together over the full periphery of the outer cylindrical body 2 along the circumferential direction thereof.

In the joint region C, of FIG. 1, as seen in FIG. 2(C), each joint, end of the outer cylindrical body 2, the porous plate 6 and the partition plate 11 is superposed and welded together at the same time from the outside of the outer cylindrical body 2 by the laser beam so as to be integrally joined together over the full periphery of the outer cylindrical body 2 along the circumferential direction thereof. Similarly, in the joint, region D of FIG. 1 the joint end of the outer cylindrical body 2, the joint end of the porous plate 6, the rear en (d plate 4 and the porous plate 8 are superposed each on the other and welded together at, the same time from the outside of the outer cylindrical body 2 by the penetrating laser beam, so that these four component parts may be integrally joined together over the full circumferences thereof. Further, in a joint region E of FIG. 1, the end plate 4, the porous plate 8 and the tail pipe 14 are placed each on the other and joined integrally with each other over the full circumferences thereof by the laser beam which is applied from an outside of the end plate 4 substantially at a right angle to the axis of the tail pipe 14.

There will be described hereunder an example of a method of assembling the exhaust muffler 1 of such a joint construction as mentioned above. Firstly, the outer cylindrical body 2 is formed from a sheet of plate material into a cylinder shape. This forming is carried out in a conventional manner by rolling a sheet of the plate material into a cylinder shape with each joint end superposed one on the other and welding the superposed joint ends along the longitudinal direction thereof. The internally installed unit 5 to be housed within the cylinder of the outer cylindrical body 2 is sub-assembled as follows. Into the openings formed on the partition plates 10, 11, 12, the communication pipes 13 and the tail pipe 14 are inserted thereby to be fixedly secured to each other. Next, the porous plate 6 is rolled around the partition plates 10, 12, 13 and provisionally fastened thereon. The thus sub-assembled internally installed unit 5 is inserted into the outer cylindrical body 2 while at the same time the acoustic absorption material 16 is accommodated within the clearance between the porous plate 6 and the outer cylindrical body 2. Then, into the front and rear ends of the outer cylindrical body 2 the respective end plates 3, 4 are engaged and provisionally fastened thereon. The exhaust pipe 15 is connected to the forward end of the central communication pipe 13 to be fixed in position. When all the component parts are fixed in position, the laser beam weldings are applied to the superposed joint regions A, B, C, D, E and F of FIG. 1. The laser beam weldings are carried out over the full peripheries of each of the joint portions in such a manner, for example, that the laser welding machine and the work are moved relative to each other along the circumferential direction of the work thereby to apply the laser beam welding to the full circular periphery of the work. According to the manufacturing processes as mentioned hereinabove, there may be effected the simplification of manufacturing steps, the improvement in air-tightness of the chambers divided by the partition plate 10, 11, 12, and the minimizations of thermal strains.

The outer cylindrical body 2 and each of the front and rear end plates 3, 4 are formed of either an aluminum-plated steel plate or a stainless steel plate, or varying combinations of both. When laser-beam-welding the aluminum-plated steel plate, by way of example, the surficial oxidized film is removed in a short time by the strong energy of the laser beam so that the welding may be easily carried out. Also, after welding, the welded region is protected through a passive anti-corrosive operation, so as not to require the after-treatment such as a coating or the like. The same benefits call be obtained with the stainless steel plate. Therefore, either the aluminum-plated steel plate or the stainless steel plate may be used for both of the outer cylindrical body 2 and the end plates 3, 4, for example, or the aluminum-plated steel plate and the stainless steel plate may be used in combination for the outer cylindrical body 2 and each of the end plates 3, 4, in such a way as to use the aluminum-plated steel plate for the end plates 3, 4 and the stainless steel plate for the outer cylindrical body 2, whereby dispensing with the after-treatment like a full surface coating after welding while complying with the requirements for diversification of designs.

Figure 3:
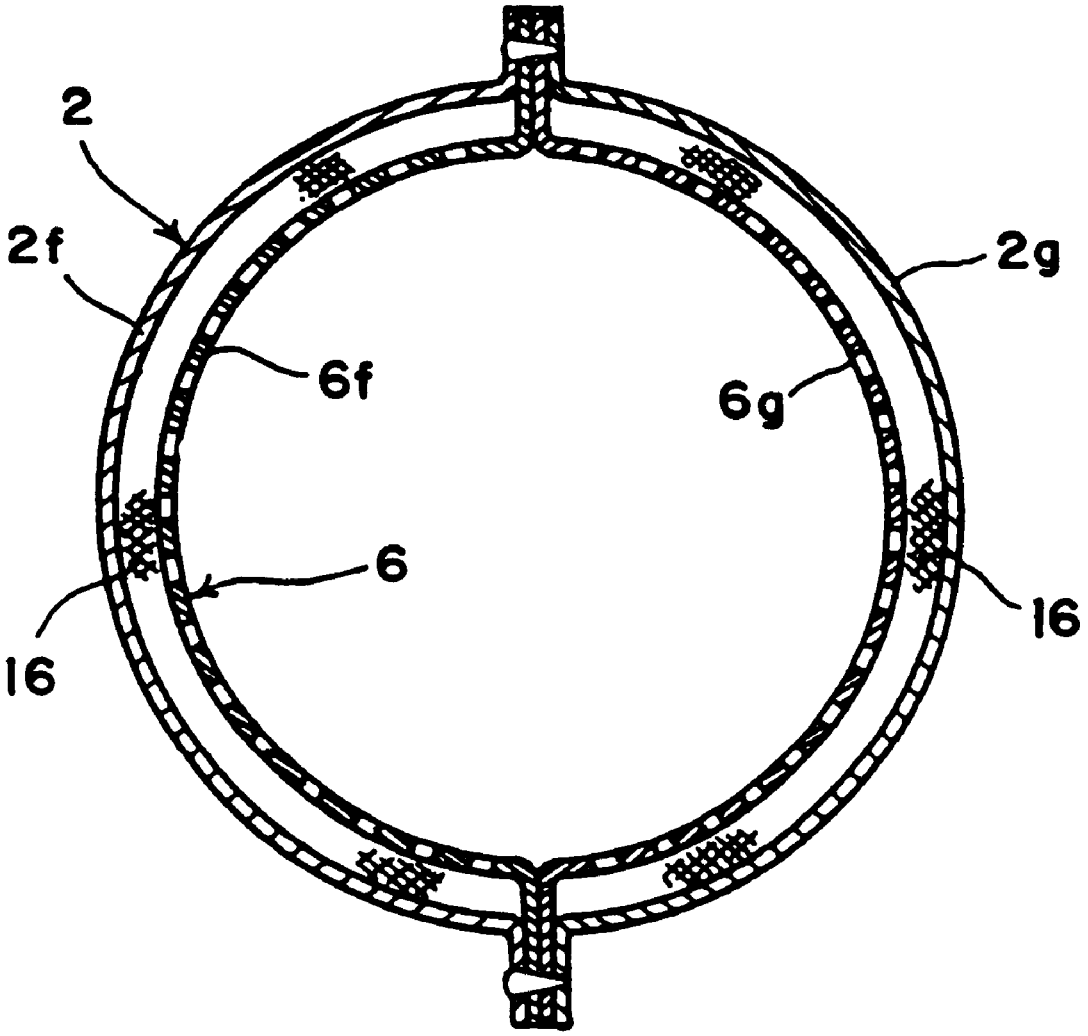
FIG. 3 is a sectional view showing a joint construction of an exhaust muffler in which an outer cylindrical body is formed with a pair of halves.
Figure 4:
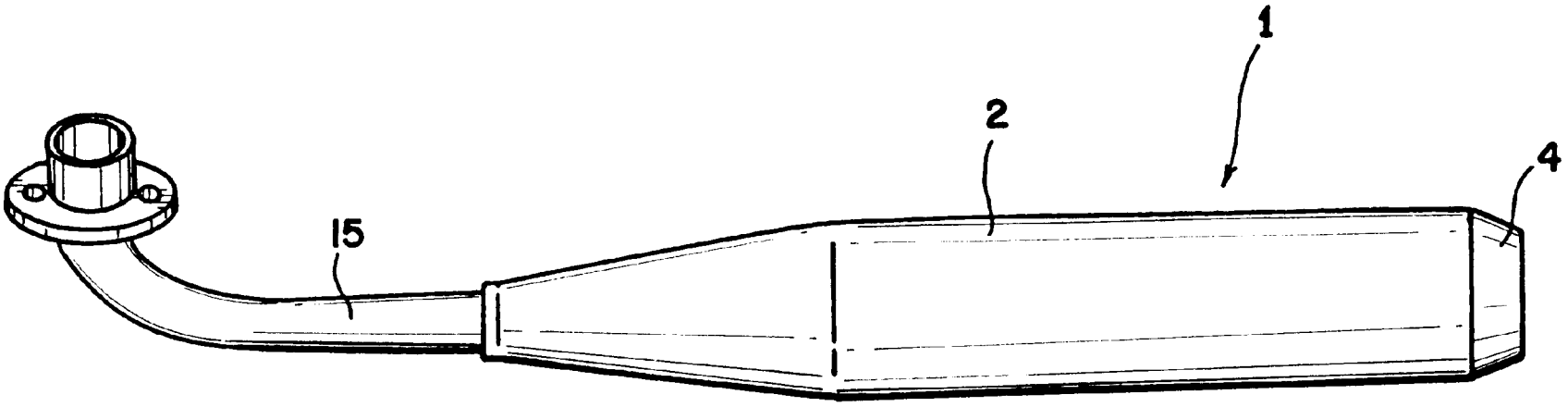
FIG. 4 is a side plan view of an exhaust muffler in which all end plate is provided only at the rear end of an outer cylindrical body.

The joining construction of the exhaust muffler 1 as mentioned hereinbefore may be applied in like manner not only to an exhaust muffler 2 in which the end plate 4 is engaged with only one side of the outer cylindrical body 2 as seen in FIG. 4, but, also to an exhaust muffler 1 in which each of an outer cylindrical body 2 and a porous plate 6 is formed of a pair of halves 2*f*, 2*g*, 6*f*, 6*g* as seen in FIG. 3. In case of the latter, the pair of halves 6*f*, 6*g* of the porous plate 6 formed in the predetermined configuration are put together at the opposed joint edges thereof so as to be fixed in position in a face-to-face fashion. The pair of half porous plates 6*f*, 6*g* are covered with the pair of the half outer cylindrical bodies 2*f*, 2*g*, and a pair of acoustic absorption materials 16 are interposed between each of the half outer cylindrical bodies 2*f*, 2*g* and each of the porous plates 6*f*, 6*g* to enclose the latter. The half outer cylindrical bodies 2*f*, 2*g* are superposed at the opposed joint edges thereof on the joint edges of the half porous plates 6*f*, 6*g* thereby to be laser beam welded together at their superposed joint edges along the longitudinal direction of the outer cylindrical body 2. In this case, due to the laser beam welding, the coupling operation may be rapidly carried out, and the manufacturing steps may be effectively reduced, while the thermal affect may be minimized to a limited extent.

FIGS. 5 through 10 illustrate modified embodiments of the present invention wherein either an outer cylindrical body 2 or a front and a rear end plates 3, 4, or all of them, are formed in a multiple-layered construction of which the outer cylindrical body 2 allows an internally installed unit 5 to be installed therein in a squeezed or tightly held condition, and wherein it is possible to achieve the second object and comply with the weight reduction, the demands of diversified design, and the reduction in cost of materials.

Figure 5:
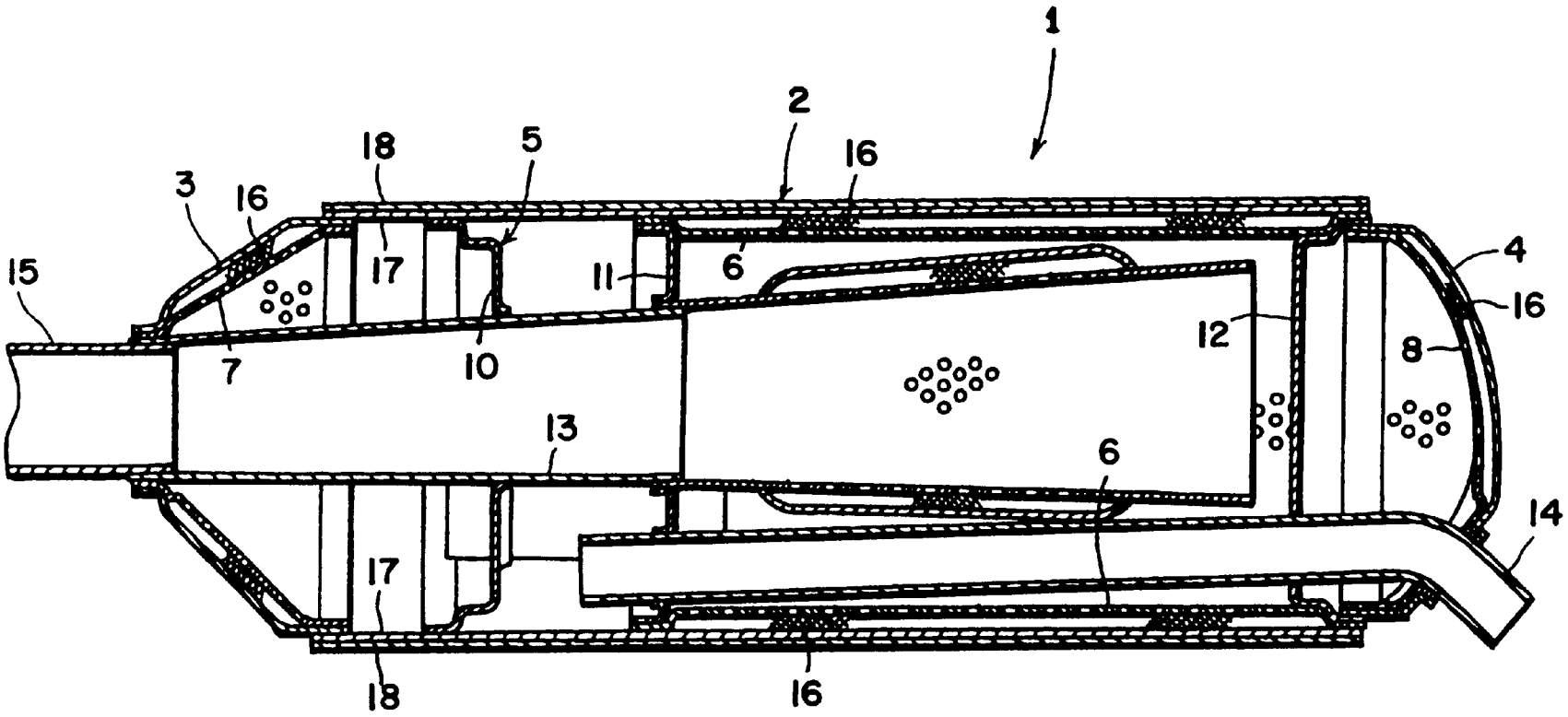
FIG. 5 is a longitudinal sectional view of an exhaust muffler, showing, as an example, an outer cylindrical body of multiple-layered construction.
Figure 7:
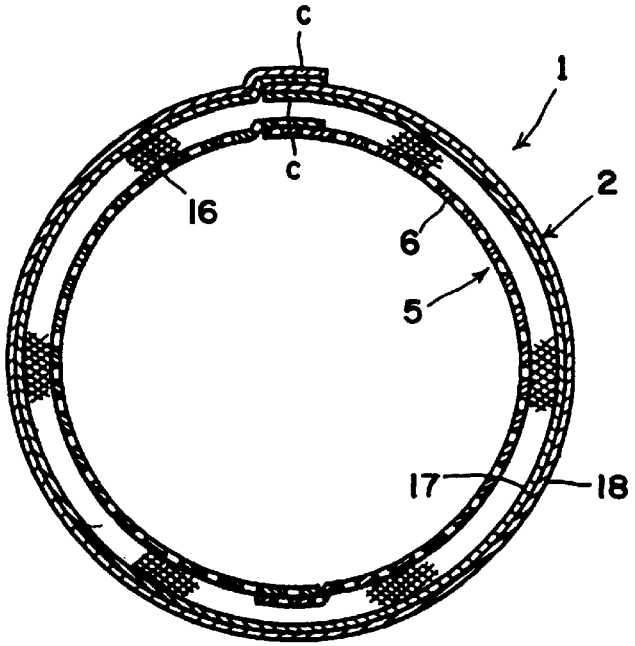
FIG. 7 is a sectional view of an exhaust muffler, taken in a vertical direction of FIG. 5, showing an example of an outer cylindrical body formed by a roll forming process.
Figure 8:
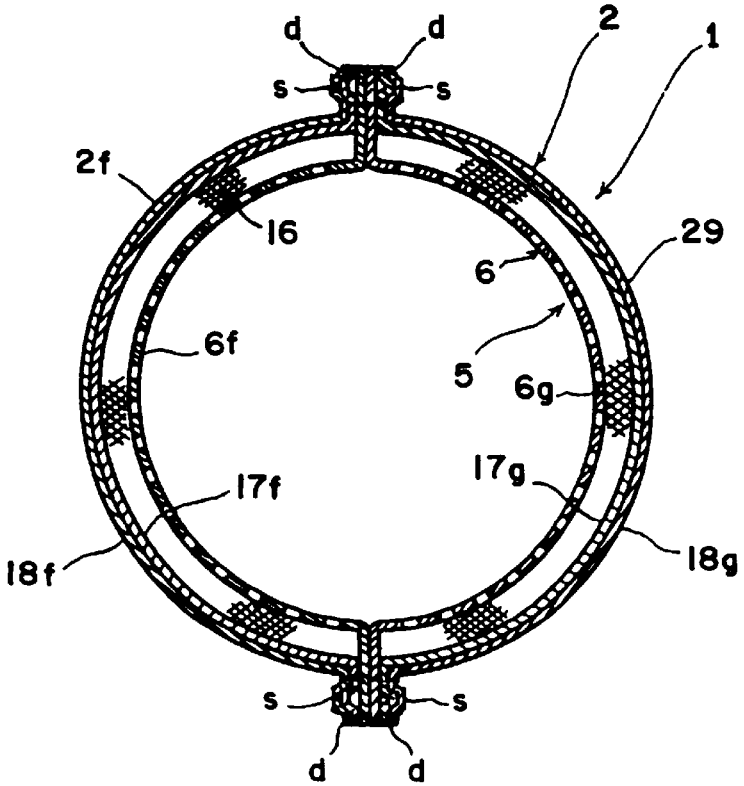
FIG. 8 is a sectional view of an exhaust muffler, taken in a vertical direction of FIG. 5, showing an example of an outer cylindrical body formed with a pair of halves.
Figure 9A:
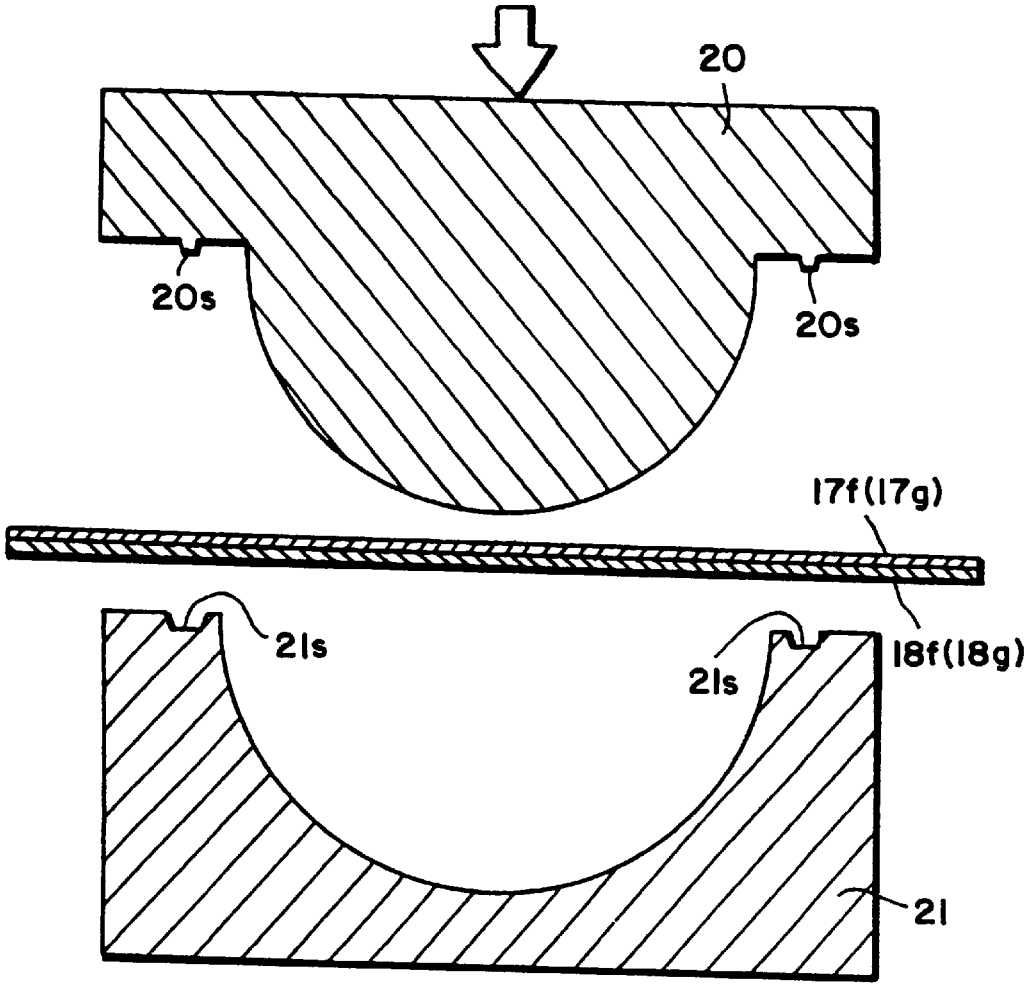
FIGS. 9(A) and 9(B) are explanatory views, showing an example of a method of forming an engaging means on an outer cylindrical body.
Figure 9B:
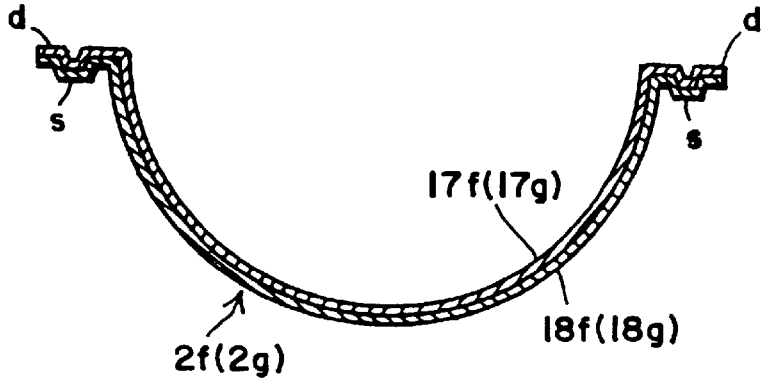

Referring now to FIG. 5, an outer cylindrical body 2 is formed in a double-layered construction, by way of example, in which an inner panel 17 and an outer panel 18 are superposed one on the other and formed simultaneously integrally with each other. An internally installed unit 5 is previously assembled into a unit to be inserted into the outer cylindrical body 2. After inserting the internally installed unit 5, the outer cylindrical body 2 is squeezed or pressed radially inwardly to the full periphery of the internally installed unit 5 and is welded at the longitudinally extending joint, ends thereof. In relation to the integral forming of the inner and outer panels 17, 18, when the outer cylindrical body 2 is formed in an integral cylinder shape as seen in FIG. 7, a roll forming process or the like is suitable, and when formed with a pair of halves 2*f*, 2*g* as seen in FIG. 8, a press forming process or the like is suitable. In case of employing the roll forming process, the inner and the outer panels 17, 18 of generally similar configuration are placed one on the other and rolled together by a roller into a cylindrical shape of a single roll like FIG. 7. The internally installed unit 5 is inserted into the thus rolled outer cylindrical body 2 and pressed or squeezed inwardly by the double-layered outer cylindrical body 2. Then, each of joint ends c, c of the outer cylindrical body 2 is superposed one on the other and welded together by MIG welding, TIG (tungsten-inert gas) welding or laser beam welding so as to fixedly secure the internally installed unit 5 in tight contact over the full periphery thereof to the inside of the outer cylindrical body 2. According to the above assembling method, no other particular measures are required for fixing the internally installed unit 5 on the inside of the outer cylindrical body 2.

In the case where the outer cylindrical body 2 is formed with the pair of halves 2*f*, 2*g*, a pair of outer panels 18*f*, 18*g* are superposed on a pair of inner panels 17*f*, 17*g*, respectively, and formed together into semi-cylindrical shapes by a press forming process as seen in FIG. 8. On each end of the semi-cylindrical halves are provided radially outwardly extending projections d, d. When each pair of opposed contact portions of the projections d, d are joined together by MIG welding, TIG welding, laser beam welding or the like, the internally installed unit 5 is fixedly secured over its full periphery to the inside of the outer cylindrical body 2, like the above-mentioned example, thereby not to require any other particular steps for fixing the internally installed unit 5 and the outer cylindrical body 2. In order to prevent the inner and the outer panels 17*f*, 18*f* or 17*g*, 18*g* from separating from each other, there are provided engaging means s, s on each of the radial projections d, d. The engaging means s, s are formed in the shape of a boss or a recess, for example, through caulking or the like on each part of the projections d, d of the superposed inner and outer panels 17*f*, 18*f* or 17*g*, 18*g* in such a way as to be engaged with each other. The engaging means s, s are not limited to the example embodied herein but are capable of optionally adopting various modifications in shape, number, position, the forming method and others. In the embodied example as seen FIG. 9(A), on the predetermined positions of a pair of an upper and a lower press forming dies 20, 21, there are provided a pair of opposed engaging means forming portions 20*s*, 21*s*, through which the engaging means s, s are formed simultaneously when the inner and the outer panels 17*f*, 18*f*, or 17*g*, 18*g* are stamped into semi-cylindrical shapes. Due to the engaging means s, s provided as above, the inner panels 17*f*, 17*g* are prevented from being separated from the outer panels 18*f*, 18*g* so as to make it easy to handle the outer cylindrical body 2, for example, upon installing the internally installed unit 5 therein.

Figure 6:
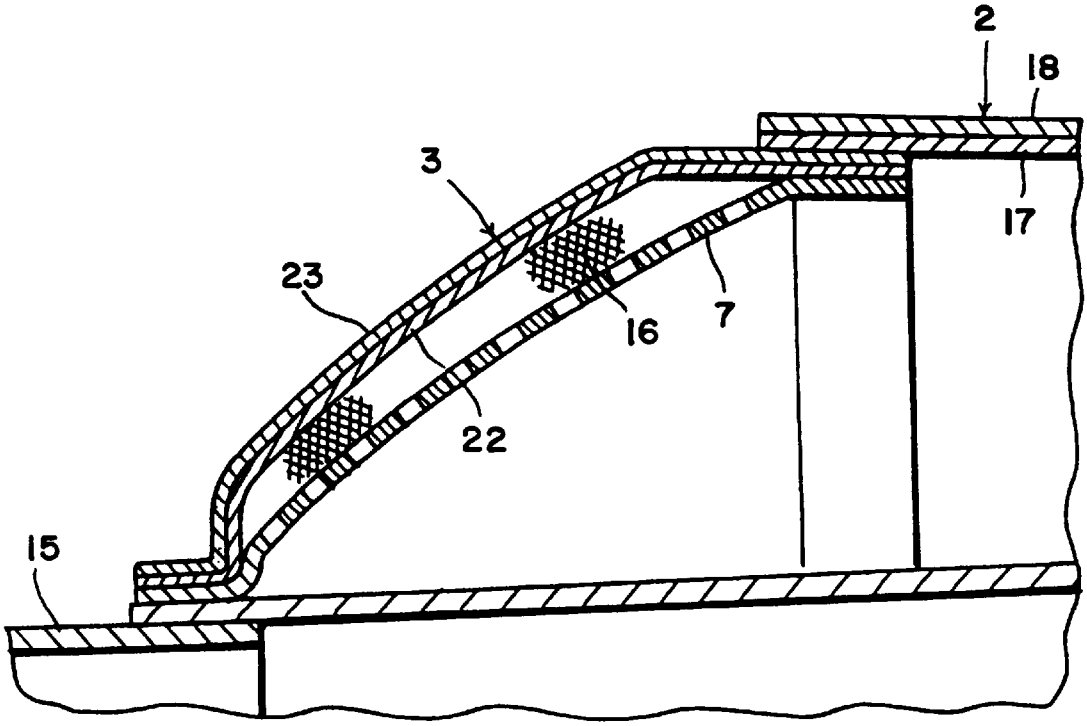
FIG. 6 is a fragmentary sectional view, in all enlarged scale, of an exhaust muffler, showing, as an example, an end plate of multiple-layered construction.

The multiple-layered construction of this kind is not limited to the outer cylindrical body 2 but is also applicable to the front and the rear end plates 3, 4 like an inner and an outer panels 22, 23 as seen in FIG. 6. The inner and outer panels 22, 23 are formed simultaneously integrally with each other by the press forming process and, if necessary, an engaging means may be provided anywhere on the inner and outer panels 22, 23 for preventing any separation therebetween.

In view of coping with the diversification of designs in external appearance, and the reduction in weight and in cost, there are formed of different or heterogeneous materials the inner panels 17, 22 and the outer panels 18, 23 with respect to the outer cylindrical body 2 and each of the end plates 3, 4. When the multiple-layered construction is formed in combination of comparatively thin and low-cost inner panels 17, 22 with comparatively thick and expensive outer panels 18, 23, for example, it is possible to obtain a lower-cost exhaust muffler having a good external appearance. When the inner panels 17, 22 are made of a rolled steel plate and the outer panels 18, 23 are made of either an aluminum-plated steel plate or a stainless steel plate, the coating after welding or the like may be omitted or dispensed with. Namely, in case the outer panels 18, 23 are formed of heat-resistant, corrosion-resistant materials such as aluminum-plated steel plate or stainless steel plate, the welded regions are protected by a passive anti-corrosive operation of the metal whereby not requiring any extra or successive step such as a partial coating or a full surface coating like an anti-corrosive coating, nor any additional winding of a stainless steel plate round the outer surface of the muffler. Further, upon making the difference in thickness between the inner panels 17, 22 and the outer panels 18, 23, for example, in such a manner as to form the inner panels 17, 22 of rolled steel plate to be 1.0 mm thick and the outer panels 18, 23 of stainless steel plate to be 0.2 mm thick, the reduction in cost as well as in weight may be further facilitated. Also, is described hereinbefore, by constructing at least either of the outer cylindrical body 2 or each of the end plates 3, 4 in a multiple layer, the noise silencing effect can be enhanced and the number of component parts can be reduced in relation to the internally installed unit 5 or the like. On the other hand, the inner and the outer panels 17, 18 of the outer cylindrical body 2 are formed integral with each other in the superposed relationship, so that the internally installed unit 5 may be installed in the outer cylindrical body 2 in the squeezed or inwardly pressed condition by the latter. Accordingly, extra steps such as welding between the outer cylindrical body 2 and the internally installed unit 5 can be omitted or dispensed with.

Figure 10:
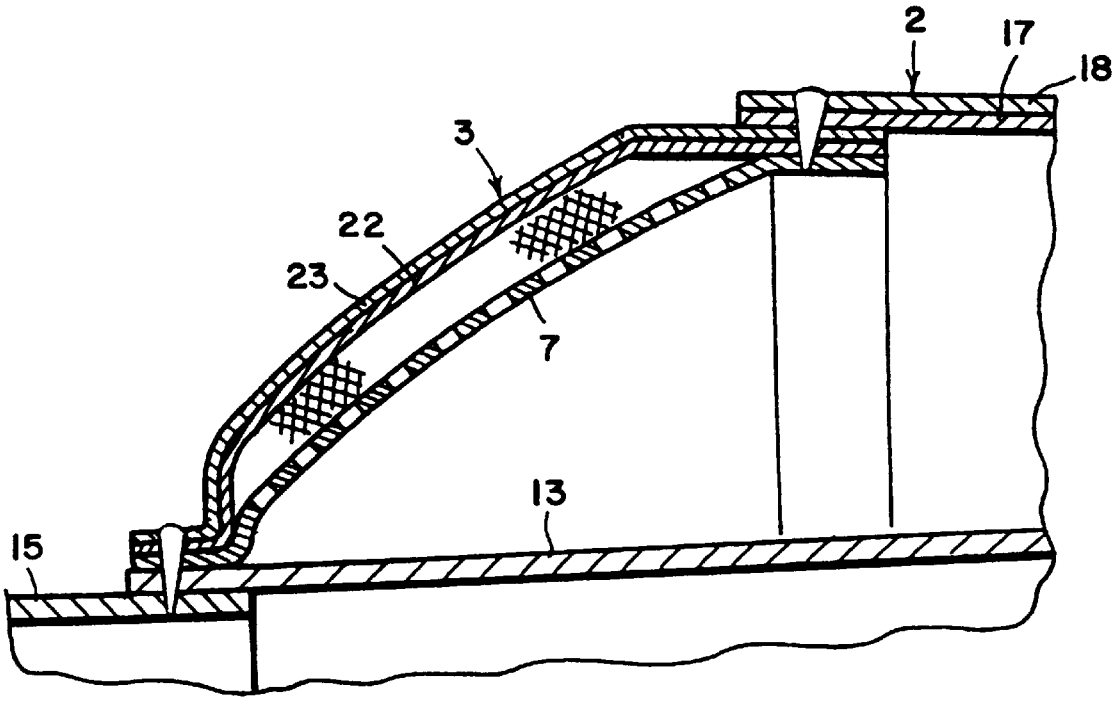
FIG. 10 is an explanatory view, showing a laser beam welded exhaust muffler in which an outer cylindrical body and an end plate are formed in a multiple-layered construction; and, FIG. 11 is a partially sectional view of a conventional exhaust muffler.
Figure 11:
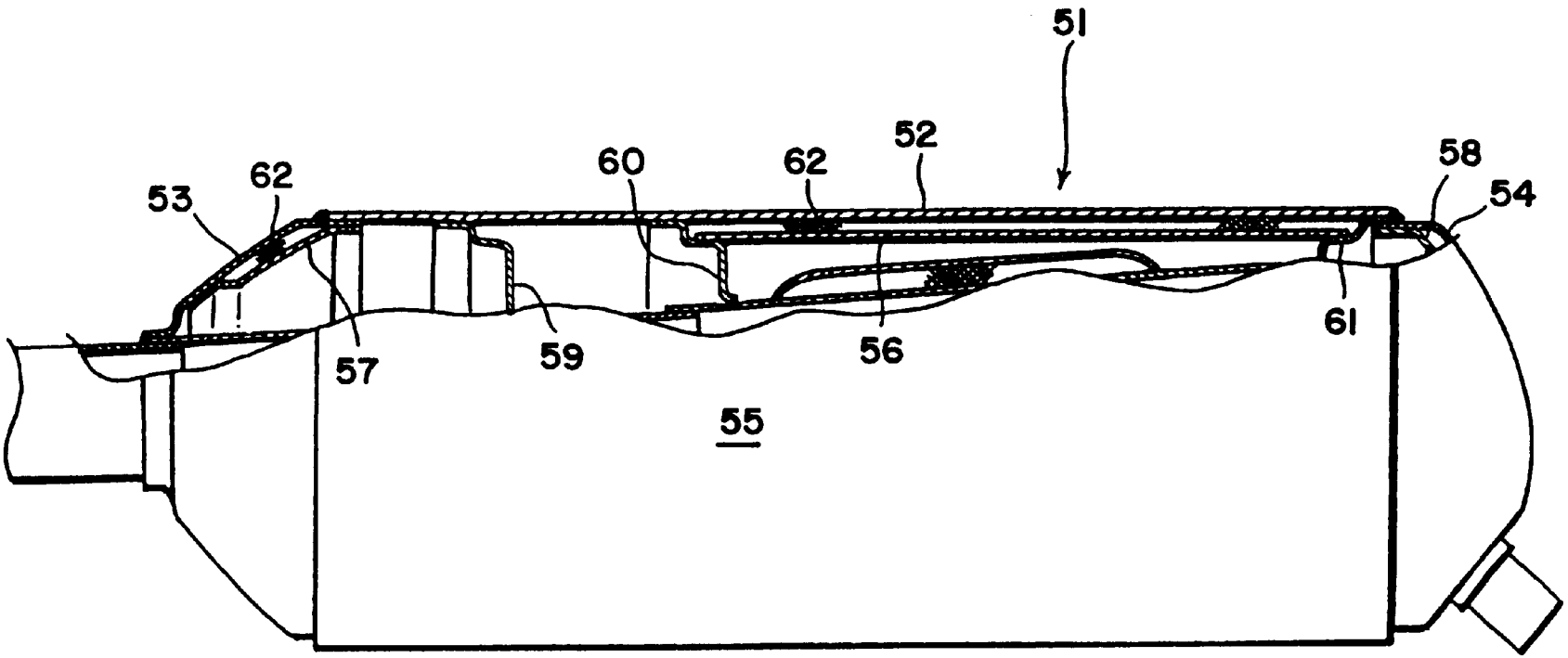
FIG. 11 PRIOR ART

It is to be understood that for the inner and the outer panels 17, 18 or 22, 23, it is possible to use the same or homogeneous materials like an SP material, a stainless steel material or the like instead of the different or heterogeneous materials as described above, and that the multiple-layered construction is not limited to the embodied double layer but includes multiple layers more than double. If the inner and the outer panels 17, 18 are integrally formed into a unit, like the present invention in case of forming the outer cylindrical body 2 in the multiple-layered shape, the internally installed unit 5 is fixedly secured to the outer cylindrical body 2 over its full periphery in the squeezed or radially inwardly pressed condition by the latter. The joining means, therefore, is not required between the internally installed unit 5 and the outer cylindrical body 2, in principle. If need be, however, it is possible to join the contact, portions between the internally installed unit 5 and the outer cylindrical body 2 by the laser beam welding, in such a manner, as seen in FIG. 10, as to superpose each on the other and laser-beam-weld together the inner and the outer panels 17 and 18 of the outer cylindrical body 2, the inner and the outer panels 22, 23 of the end plate 3 and the porous plate 7, or as to superpose each on the other and laser-beam-weld together the inner and the outer panels 22, 23 of the end plate 3, the porous plate 7, the communication pipe 13 and the exhaust pipe 15. In this instance, if a heat-resistant and corrosion-resistant material such as an aluminum-plated steel plate, a stainless steel plate or the like is utilized for the outer panels 18, 23, there is not required the after-treatment such as a coating or the like, after welding.

Although there has been described what is at present considered to be the preferred embodiment of the present invention, it will be understood that the invention may be embodied in other specific forms without departing from the essential characteristics thereof. The present embodiments are therefore to be considered in all respects as illustrative, and not restrictive. The scope of the invention is indicated by the appended claims rather than by the foregoing description.

What is claimed is:

1. An exhaust muffler comprising:

an outer cylindrical body formed in a multiple-layered construction with inner and outer panels, an end plate coupled through its joint portion with at least a side of a front or a rear end of said cylindrical body, and an internally installed unit adapted to be arranged within said outer cylindrical body, said internally installed unit comprising a porous plate arranged on and spaced apart from at least one of plural inside surfaces of said outer cylindrical body and said end plate, and a partition plate adapted to partition an internal space defined by said cylindrical body in a forward and rearward direction thereof, said inner and said outer panels being integrally formed together into a substantially same configuration in a superposed relationship, wherein said inner and outer panels of said outer cylindrical body are superposed each on the other and rolled once up into a cylindrical shape simultaneously by a roll forming process.

2. An exhaust muffler according to claim 1, wherein said inner and outer panels of either said outer cylindrical body or said end plate are formed of heterogeneous materials.

3. An exhaust muffler according to claim 2, wherein said outer cylindrical body and said end plate are made of either an aluminum-plated steel plate or a stainless steel plate, or of varying combinations of both.

4. An exhaust muffler according to claim 1, wherein said inner and outer panels of either said outer cylindrical body or said end plate are formed with different thickness.

5. An exhaust muffler according to claim 1, wherein said outer panel is formed of heat-resistant and corrosion-resistant material and said inner panel is formed of a rolled steel plate.

6. An exhaust muffler comprising:

an outer cylindrical body formed in a multiple-layered construction with inner and outer panels, an end plate coupled through its joint portion with at least a side of a front or a rear end of said outer cylindrical body, and an internally installed unit adapted to be arranged within said outer cylindrical body, said internally installed unit comprising a porous plate arranged on and spaced apart from at least one of plural inside surfaces of said outer cylindrical body and said end plate, and a partition plate adapted to partition an internal space defined by said outer cylindrical body in a forward and rearward direction thereof, said inner and said outer panels being integrally formed together into a substantially same configuration in a superposed relationship, wherein said outer cylindrical body is formed with a pair of halves, each of which is provided with inner and outer panels pressed together and integrally formed into shape in a superposed relationship.

7. An exhaust muffler according to claim 6, further comprising an end plate for covering the end of said outer cylindrical body, wherein said end plate is formed with inner and outer panels which are superposed each on the other and integrally formed simultaneously by a press forming process.

8. An exhaust muffler according to claim 6, wherein said inner and outer panels of either said outer cylindrical body or said end plate are formed of heterogeneous materials.

9. An exhaust muffler according to claim 8, wherein said outer cylindrical body and said end plate are made of either an aluminum-plated steel plate or a stainless steel plate, or of varying combinations of both.

10. An exhaust muffler according to claim 6, wherein said inner and outer panels of either said outer cylindrical body or said end plate are formed with different thickness.

11. An exhaust muffler according to claim 6, wherein said outer panel is formed of heat-resistant and corrosion-resistant material such as a stainless steel plate, an aluminum-plated steel plate, and said inner panel is formed of a rolled steel plate.

12. An exhaust muffler according to claim 6, wherein upon forming either said outer cylindrical body or said end plate, an engaging means is provided for engagement between said inner and outer panels.

13. An exhaust muffler according to claim 6, wherein said pair of porous plates are interposed at their joint between joint portions of said pair of halves of said outer cylindrical body so as to be integrally joined to each other by laser beam welding.

14. An exhaust muffler according to claim 13, comprising an exhaust pipe connected to said end plate at the front end of said outer cylindrical body, wherein said porous plate is interposed through its joint portion between said exhaust pipe and said end plate so as to be integrally joined to each other by the laser beam welding.

15. An exhaust pipe according to claim 13, comprising a tail pipe connected to said rear end plate, wherein said porous plate is interposed through its joint portion between said tail pipe and said rear end plate so as to be integrally joined to each other by the laser beam welding.

16. An exhaust muffler comprising:

an outer cylindrical body formed in a multiple-layered construction with inner and outer panels, an end plate coupled through its joint portion with at least one of the front and rear ends of said cylindrical body, and an internally installed unit adapted to be arranged within said cylindrical body, said internally installed unit comprising a porous plate arranged on and spaced apart from the inside surface of at least one of said cylindrical body and said end plate, and a partition plate adapted to partition an internal space defined by said cylindrical body into chambers arranged in the longitudinal direction of said cylindrical body, wherein said outer cylindrical body is formed with at least two panels having substantially the same configuration and formed together into a cylindrical shape of a single roll by a roll forming while they are being superposed each on the other.

17. An exhaust muffler comprising:

an outer cylindrical body formed in a multiple-layered construction with inner and outer panels, an end plate coupled through its joint portion with at least one of the front and rear ends of said outer cylindrical body, and an internally installed unit adapted to be arranged within said outer cylindrical body, said internally installed unit comprising a porous plate arranged on and spaced apart from the inside surface of at least either one of said outer cylindrical body and said end plate, and a partition plate adapted to partition an internal space defined by said outer cylindrical body into chambers arranged in the longitudinal direction thereof, wherein said outer cylindrical body is formed with a pair of halves, each of said halves including at least two panels having substantially the same configuration and formed together into a semi-cylindrical shape by a press forming while they are being superposed each on the other.

* * * * *